US007862863B2

(12) United States Patent
Kobayashi

(10) Patent No.: US 7,862,863 B2
(45) Date of Patent: Jan. 4, 2011

(54) METHOD FOR MANUFACTURING AN INKJET RECORDING MEDIUM

(75) Inventor: Masamichi Kobayashi, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 296 days.

(21) Appl. No.: 12/212,931

(22) Filed: Sep. 18, 2008

(65) Prior Publication Data

US 2009/0087568 A1 Apr. 2, 2009

(30) Foreign Application Priority Data

Sep. 28, 2007 (JP) ..... 2007-256001

(51) Int. Cl.
*B05D 1/36* (2006.01)

(52) U.S. Cl. ..... 427/411; 427/361; 427/365

(58) Field of Classification Search ..... None
See application file for complete search history.

(56) References Cited

U.S. PATENT DOCUMENTS 6,613,388 B1 * 9/2003 Kashiwabara et al. ..... 427/348
2006/0045998 A1 * 3/2006 Kitamura et al. ..... 428/32.24

FOREIGN PATENT DOCUMENTS

| | | |
|---|---|---|
| JP | 2002-225423 A | 8/2002 |
| JP | 2004-203010 A | 7/2004 |
| JP | 2004-230599 A | 8/2004 |

* cited by examiner

*Primary Examiner*—Erma Cameron
(74) *Attorney, Agent, or Firm*—Sughrue Mion, PLLC

(57) ABSTRACT

The present invention provides a method for manufacturing an inkjet recording medium having at least applying, on a support, a coating liquid A, a coating liquid B and a coating liquid C in this order from the support to form an ink receiving layer. The coating liquid A contains at least a crosslinking agent. The coating liquid B contains at least a vapor-phase-process silica and a water-soluble binder, in which the content of a pseudo boehmite alumina hydrate with respect to the content of the vapor-phase-process silica in the coating liquid B is less than 3% by mass, and the content of a crosslinking agent with respect to the content of the vapor-phase-process silica in the coating liquid B is less than 3% by mass. The coating liquid C contains at least a pseudo boehmite alumina hydrate and a water-soluble binder.

8 Claims, No Drawings

METHOD FOR MANUFACTURING AN INKJET RECORDING MEDIUM

CROSS-REFERENCE TO RELATED APPLICATION

This application claims priority under 35 USC 119 from Japanese Patent Application No. 2007-256001, the disclosure of which is incorporated by reference herein.

BACKGROUND OF THE INVENTION

1. Field of Invention

The present invention relates to a method for manufacturing an inkjet recording medium.

2. Description of the Related Art

Recently, various information processing systems have been developed along with rapid development in the Information Technology (IT) industry, and recording methods and recording devices suitable for respective information processing systems have also been developed and practically used. Among these, an inkjet recording method has been broadly used because it has such advantages that images are recordable on various kinds of recording materials, hard wares (devices) for the inkjet recording method can be manufactured at a comparatively low cost and made compact as well, excellent stillness can be provided, and the like. The latest inkjet recording method can provide so-called "picture like" high quality images.

The recording materials for inkjet recording have been generally required to have properties such as (1) quick drying (high ink absorption speed), (2) ink dots having proper and uniform diameters (no bleeding), (3) excellent granularity, (4) high circularity of dots, (5) high color density, (6) high color saturation (no dullness), (7) excellent water proof, light fastness, and ozone proof at an imaging area, (8) high degree of whiteness, (9) excellent storability of a recording medium (no occurrence of yellow discoloration or image bleeding during long term storage), (10) low deformability and excellent dimensional stability (low curling properties) or (11) excellent running properties in hardware.

In view of the above, in recent years, inkjet recording media (inkjet recording materials) having an ink receiving layer with a porous structure have been put into practical use, and various studies have been made thereof.

For example, to suppress coating defects and obtain good ink absorbability, a technique is known in which an ink receiving layer is formed by performing a first coating step wherein a first coating liquid containing a crosslinking agent is coated on a substrate, and a second coating step wherein a second coating liquid containing inorganic fine particles and a binder is coated thereon, wherein the second coating liquid is crosslinked and cured on the layer formed by the first step, at the same stage of coating the first coating liquid in the first step, or before the first coating liquid coated in the first step is dried and cured (for example, see Japanese Patent Application Laid-Open (JP-A) No. 2004-230599).

In order to improve ink absorptivity, glossiness and printing density, a technique is known in which at least two ink receiving layers are provided on a water-resistant support: an ink receiving layer (A) which is provided closer to the water-resistant support and which contains vapor-phase-process silica, boric acid or borate, and polyvinyl alcohol with a polymerization degree of less than 3,000; and an ink receiving layer (B), which is provided further from the water-resistant substrate and which contains an alumina or an alumina hydrate, boric acid or borate, and polyvinyl alcohol with a polymerization degree of 3,000 or more (for example, see Japanese Patent Application Laid-Open (JP-A) No. 2002-225423).

Further, in order to obtain high glossiness with photo-like quality and high ink absorptivity, and to improve indoor image storability, a technique is known in which an ink receiving layer includes polymer compounds having a structure with a thiourea group, particularly, a polyamine with a thiourea group (see, for example, Japanese Patent Application Laid-Open (JP-A) No. 2004-203010).

It is also known that in a system in which a pseudo boehmite alumina hydrate, a water-soluble binder and a crosslinking agent are contained, aggregation tends to occur, and coating defects such as cracks are apt to arise. Accordingly, both of high printing density and suppression of coating defects cannot always be achieved by using only the techniques disclosed above.

SUMMARY OF THE INVENTION

The present invention has been made in view of the above circumstances, and provides a method for manufacturing an inkjet recording medium capable of obtaining a high printing density and suppressing coating defects.

Namely, an aspect of the present invention is a method for manufacturing an inkjet recording medium comprising coating, on a support: at least (A) a coating liquid A containing a crosslinking agent; (B) a coating liquid B containing vapor-phase-process silica and a water-soluble binder, in which the content of a pseudo boehmite alumina hydrate relative to the content of the vapor-phase-process silica, and the content of a crosslinking agent relative to the content of the vapor-phase-process silica are less than 3% by mass, respectively; and (C) a coating liquid C containing a pseudo boehmite alumina hydrate and a water-soluble binder; in this order from the support to form an ink receiving layer.

DETAILED DESCRIPTION OF THE INVENTION

Hereinafter, the method for manufacturing an inkjet recording medium according to the invention will be described in detail.

The method for manufacturing an inkjet recording medium of the invention comprises coating, on a support, at least (A) a coating liquid A containing a crosslinking agent, (B) a coating liquid B containing vapor-phase-process silica and a water-soluble binder, in which the content of a pseudo boehmite alumina hydrate relative to the content of vapor-phase-process silica, and the content of a crosslinking agent relative to the content of the vapor-phase-process silica are less than 3% by mass, respectively, and (C) a coating liquid C containing a pseudo boehmite alumina hydrate and a water-soluble binder, in this order from the support (namely, in the order of the coating liquid A, the coating liquid B and the coating liquid C from the support), to form an ink receiving layer. The ink receiving layer may further include other coating liquids as necessary.

Although the pseudo boehmite alumina hydrate is a component that contributes to improving the printing density, it has been found that aggregation and thickening of a coating liquid tend to occur in a system in which a pseudo boehmite alumina hydrate, vapor-phase-process silica, and a crosslinking agent are contained; thus coating defects tend to occur in a coated layer formed by using this coating liquid. The present inventors have found that, by applying the above method of the present invention in the manufacture of inkjet recording media, contact between the pseudo boehmite alumina hydrate, the crosslinking agent and the water-soluble resin can be prevented, thus effectively preventing the occurrence of coating defects. Through this method, a high printing density can be achieved and an inkjet recording medium can be manufactured with substantial suppression of coating defects thereof.

Preparation of Coating Liquid

In the invention, methods for preparing the coating liquid A, the coating liquid B and the coating liquid C are not specifically limited. The components contained in each coating liquid may be mixed and agitated by known methods. From the viewpoint of effective suppression of coating defects, for preparing the coating liquid B or C, a preferable method is that a dispersion liquid of fine particles (a dispersion liquid of vapor-phase-process silica or a dispersion liquid of pseudo boehmite alumina hydrate) is first prepared, and then the dispersion liquid of fine particles is mixed with other components (such as a water-soluble binder). In this case, the dispersion liquid of fine particles and the other components is preferably maintained at the same temperature and mixed while maintaining this temperature. Specifically, for the preparation of the coating liquid B, the temperature is preferably from 20° C. to 50° C., and more preferably from 25° C. to 40° C. For the preparation of the coating liquid C, the temperature is preferably from 40° C. to 70° C., and more preferably from 45° C. to 65° C.

Application of Coating liquids

In the invention, the application of coating liquids A, B and C may be performed by a simultaneous multi-layer coating of coating liquids A, B and C, by a sequential coating of coating liquids A, B and C, or by a combination of simultaneous multi-layer coating and the sequential coating. Here, the application is carried out by known methods. Examples of these methods include a slide bead coating method, a curtain coating method, an extrusion coating method, an air knife coating method, a roll coating method or a rod bar coating method.

Sequential coating is a method, in which, for example, the coating liquids A, B and C are sequentially coated one by one in this order.

In the invention, examples of embodiments using sequential coating include (1) an embodiment in which coating liquids A, B and C are sequentially coated in this order one by one, (2) an embodiment in which first coating liquids A and B are simultaneously multi-layer coated, and coating liquid C is subsequently coated thereafter, or (3) an embodiment in which coating liquid A is first coated, and then coating liquids B and C are simultaneously multi-layer coated thereafter.

When sequential coating is carried out, the other coating liquids may be coated before a coating liquid that has already been coated on a support (hereinafter, may be referred to as "lower layer coating liquid") is dried, or after the lower layer coating liquid is dried. For example, a "wet-on-wet" (WOW) method as described in JP-A No. 2005-14593, paragraph numbers [0016] to [0037] may be used.

In a simultaneous multi-layer coating is a method, at least two (preferably all of the coating liquids) of the coating liquids A, B and C are simultaneously coated without performing drying.

Among these methods, simultaneous multi-layer coating is preferable from the viewpoint of suppressing mixing of the components of the respective coating liquids, and in view of productivity. In particular, simultaneous multi-layer coating using a slide bead coating method, a curtain coating method or the like is preferable.

Drying

The coating film (ink receiving layer) formed by coating can be dried by known methods. The temperature for drying the film varies in accordance with heat resistance properties of the support, but is preferably in a range of from 10° C. to 100° C., and more preferably in a range of from 20° C. to 80° C. Further, after coating, the ink receiving layer is sufficiently dried, and thereafter subjected to a heat treatment as long as the support is not adversely affected, whereby the pore volume of the ink receiving layer can be made larger, thus making it possible to improve ink absorptivity and water-resistance. The temperature for conducting the heat treatment varies according to the heat resisting properties of the support, but is preferably from 30° C. to 80° C., and more preferably from 40° C. to 60° C.

Ink Receiving Layer

In the manufacturing method for inkjet recording media of the invention, an ink receiving layer is formed as a multilayer by applying, on a support, the coating liquid A, the coating liquid B and the coating liquid C in this order from the support.

The ink receiving layer may have a multilayer structure composed of at least three clearly distinguishable layers, such as a layer formed by the coating liquid A, a further layer formed by the coating liquid B and a further layer formed by the coating liquid C, or may have a multilayer structure composed of indistinguishable layers such as one in which the layers mix at the interfaces therebetween.

The total thickness of the ink receiving layer is not specifically restricted, but from the point of view of ink absorptivity, the thickness is preferably from 10 μm to 50 μm, and more preferably from 25 μm to 45 μm.

Hereinafter, each component in the ink receiving layer (namely, in the coating liquid A, the coating liquid B and the coating liquid C), and the support of the invention is described.

Pseudo Boehmite Alumina Hydrate

The coating liquid C of the invention contains at least one pseudo boehmite alumina hydrate. The pseudo boehmite alumina hydrate may be contained in coating liquids other than the coating liquid C. However, when the pseudo boehmite alumina hydrate is contained in the coating liquid B, the content of the pseudo boehmite alumina hydrate is less than 3 mass % with respect to the content of a vapor-phase-silica contained in the coating liquid B.

When the content of the pseudo boehmite alumina hydrate is 3 mass % or more, coating defects may worsen. In order to prevent coating defects, it is preferable not to include a substantial amount of pseudo boehmite alumina hydrate in the coating liquid B.

The pseudo boehmite alumina hydrate used in the invention is represented by the formula $Al_2O_3.nH_2O$ ($1<n<3$), wherein n is larger than 1 but less than 3.

Hereinafter, the pseudo boehmite alumina hydrate may be simply referred to as "alumina hydrate".

The alumina hydrate may be a crystalline form or an amorphous form, and the shape of the alumina hydrate may be any one of an indefinite shape, a spherical shape, a plate-like shape and the like, or may be a combination of plural shapes.

An average primary particle diameter of the alumina hydrate is preferably from 3 nm to 30 nm, and more preferably from 3 nm to 20 nm. The aspect ratio of the alumina hydrate is preferably 2 or more.

An alumina hydrate pulverized to about 50 nm to 300 nm in size can be preferably used, wherein the alumina hydrate is obtained by treating secondary particle crystals thereof, having diameters of several thousand to several tens of thousands of nm, with an ultrasonic or high pressure homogenizer, a counter collision jet pulverizer, or the like.

Acids such as lactic acid, acetic acid, formic acid, nitric acid, hydrochloric acid, hydrobromic acid and aluminum chloride may be used for dispersing the alumina hydrate of the invention.

In the invention, the average primary particle diameter of the alumina hydrate can be determined by observing the dispersed particles via electron microscopy, as the average diameter of 100 circles within a certain area, wherein each circle has an area equivalent to the projection area of the corresponding dispersed particle. As average primary particle diameters of the alumina hydrate, nominal values of commercially available products may be used.

In the case of spindle-shaped particles, the average diameter thereof can be obtained as the ratios of long axial diameters to short axial diameters thereof. The average thickness of plate-shaped alumina hydrate can be determined by observing the cut face of a sheet formed by coating the alumina hydrate thereon. The aspect ratio of the alumina hydrate can be determined as a ratio of the average particle diameter to the average thickness of the alumina hydrate. The average secondary particle diameter of alumina hydrate can be measured by using a diluted dispersion with a laser diffraction/scattering particle size distribution analyzer. The average primary particle diameter and the average secondary particle diameter of fine particles of vapor-phase-process silica can also be determined by a method similar to that of the alumina hydrate.

In order to improve an ink absorption speed of the ink receiving layer, the average pore radius of the alumina hydrate is preferably in a range of from 1 nm to 10 nm, and particularly preferably in a range of from 2 nm to 7 nm. When the average pore radius is within the above ranges, ink absorptivity and fixation efficiency of dye in ink can be improved and occurrences of image bleeding can be prevented.

In order to increase an ink absorption volume of the ink receiving layer, the pore volume of the alumina hydrate is preferably in a range of from 0.1 ml/g to 0.8 ml/g, and particularly preferably in a range of from 0.4 ml/g to 0.6 ml/g. When the pore volume is within the above ranges, occurrences of cracking and powder falling at the ink receiving layer can be prevented, and the ink receiving layer can exhibit excellent ink absorbability. Further, when the pore radius is in a range of from 2 nm to 10 nm, the pore volume is preferably 0.1 ml/g or larger. When the pore volume is within the above range, adsorption property of dye in ink can be improved. Further, solvent absorbing amount per unit area of the ink receiving layers is preferably 5 ml/$m^2$ or more, and particularly preferably 10 ml/$m^2$ or more. When the solvent absorbing amount is within the above ranges, particularly an overflow of ink during multicolor printing can be prevented.

In order to absorb and fix a dye in ink sufficiently, a BET specific surface area of the alumina hydrate is preferably in a range of from 70 $m^2$/g to 300 $m^2$/g. When the BET specific surface area is within the above range, the alumina hydrate can be dispersed sufficiently, fixation efficiency of a dye in ink can be improved without deviation of pore diameter distribution, and occurrence of image bleeding can be prevented.

In order to increase the concentration of an alumina hydrate dispersion liquid, the number of surface hydroxyl groups of the alumina hydrate is preferably $10^{20}$/g or more. When the number of the surface hydroxyl groups is small, aggregation of the alumina hydrate may tend to occur thus making it difficult to increase the concentration of the dispersion liquid.

The alumina hydrate may be produced by known methods, such as hydrolysis of aluminum alkoxides such as aluminum isopropoxide, neutralization of an aluminum salt by alkali, or hydrolysis of aluminate salts. Further, the particle diameter, the pore radius, the pore volume, the specific surface area, and the number of the surface hydroxyl groups of the alumina hydrate can be controlled by adjusting a precipitation temperature, a maturing time, a pH of a solution, a concentration of the solution, coexistent salts and the like.

Methods for hydrolyzing aluminum alkoxide are disclosed in JP-A Nos. 57-88074, 62-56321, 4-275917, 6-64918, 7-10535, and 7-267633, and U.S. Pat. No. 2,656,321, Am. Ceramic Soc. Bull., 54, 289 (1975) and the like. Examples of the aluminum alkoxides include isopropoxide, propoxide, 2-butoxide and the like. By using these methods, an alumina hydrate having extremely high purity can be obtained.

Other examples of a method for obtaining an alumina hydrate include methods disclosed in JP-A Nos. 54-116398, 55-23034, 55-27824, and 56-120508 in which inorganic salts of aluminum or their hydrates are used as a starting material. Examples of the inorganic salts include: inorganic salts such as aluminum chloride, aluminum nitrate, aluminum sulfate, poly aluminum chloride, ammonium alum, sodium aluminate, potassium aluminate, or aluminum hydroxide; and hydrates thereof.

More specifically, the alumina hydrate can be prepared by a neutralization of an aqueous acidic aluminum salt solution such as aluminum sulfate, aluminum nitrate or aluminum chloride, by reaction with an aqueous basic solution such as sodium aluminate, sodium hydroxide or aqueous ammonia. The aqueous acidic aluminum salt solution and the basic solution are generally mixed with each other to the extent that the amount of the alumina hydrate to be produced in the solution does not exceed 5% by mass, and the reaction is performed under the conditions that pH is adjusted to a range of from 6 to 10, and the temperature is kept at from 20° C. to 100° C. Further, an alumina hydrate can be produced by a method disclosed in JP-A No. 56-120508 in which crystals of the alumina hydrate are grown by changing pH alternately at an acid side and at a base side, by a method disclosed in Japanese Patent Application Publication (JP-B) No. 4-33728 in which an alumina hydrate obtained from the inorganic salt of aluminum and alumina obtained by a Beyer method are mixed with each other to thereby rehydrate alumina, and the like.

Further, in order to improve printing density, the total amount of the pseudo boehmite alumina hydrate in the ink receiving layer is preferably from 5 g/$m^2$ to 40 g/$m^2$, and more-preferably from 10 g/$m^2$ to 30 g/$m^2$. In view of preventing the occurrence of cracking and obtaining a desired level of ink absorptivity, the content of the pseudo boehmite alumina hydrate in the coating liquid C is preferably from 70 mass % to 95 mass %, and more preferably from 80 mass % to 92 mass % with respect to the total solid content of the coating liquid C.

Vapor-Phase-Process Silica

The coating liquid B of the invention contains at least one vapor-phase-process silica. The vapor-phase-process silica may also be contained in a coating liquid other than the coating liquid B. Synthetic silica can be produced by a wet process or a vapor-phase process. In most cases, silica fine particles generally refer to wet process-silica. Examples of wet process-silica include (1) silica sol obtained by the double decomposition of sodium silicate with an acid or the like, or obtained by passing sodium silicate through an ion exchange resin layer; (2) colloidal silica obtained by heating and ripening the silica sol; (3) silica gel in the form of three-dimensional secondary particles containing primary particles bound to one another via siloxane bonds, in which the primary particles are formed to have sizes of from several μm to about 10 μm by gelling silica sol according to various formation conditions; and (4) silica-acid-based synthetic silicic acid compounds obtained by heating silica sol, sodium silicate, sodium aluminate and the like.

The vapor-phase-process silica used in the invention is also called dry process silica, and is generally produced by a flame hydrolysis process. Specifically, to produce vapor-phase-process silica, a method in which silicon tetrachloride is burned with hydrogen and oxygen is generally known. In place of silicon tetrachloride, silanes such as methyl trichlorosilane and trichlorosilane can also be used alone or while mixed with silicon tetrachloride. Vapor-phase-process silica is commercially available as AEROSIL (trade name, manufactured by Nippon Aerosil Co., Ltd.), or as the QS series (trade name, manufactured by Tokuyama Corp).

In order to obtain a higher glossiness, the average primary particle diameter of the vapor-phase-process silica of the invention is preferably from 3 nm to 50 nm, and more preferably 3 nm to 20 nm.

The vapor-phase-process silica is generally formed by aggregating secondary particles, whereby appropriate spaces are formed therebetween. In order to improve glossiness and ink absorptivity, preferably, the vapor-phase-process silica containing primary particles having an average particle diameter of from 3 nm to 50 nm is pulverized and dispersed by an ultrasonic or high pressure homogenizer, a counter collision jet pulverizer or the like, until the diameter of a secondary particle is 500 nm or less and preferably from 180 nm to 400 nm.

In order to improve printing density, both of the average primary particle diameter of the vapor-phase-process silica and the average primary particle diameter of pseudo boehmite alumina hydrate are preferably from 3 nm to 20 nm, and particularly preferably from 7 nm to 15 nm.

In view of ink absorptivity, the total amount of the vapor-phase-process silica in the ink receiving layer is preferably from 2 g/m$^2$ to 17 g/m$^2$, and more preferably from 5 g/m$^2$ to 13 g/m$^2$. In order to prevent the occurrence of cracking and to improve ink absorptivity, the content of the vapor-phase-process silica in the coating liquid B is preferably from 60 mass % to 90 mass %, and more preferably from 75 mass % to 85 mass % with respect to the total solid content of the coating liquid B.

Water-Soluble Binder

The coating liquid B and the coating liquid C of the invention contain at least one water-soluble binder. The binder contained in the coating liquid B may be the same as or different from the binder contained in the coating liquid C. Further, the water-soluble binder may be contained in the coating liquid A, and may be contained in other coating liquids. However, the binder contained in the coating liquid A is preferably a water-soluble binder such as polyethylene oxide that does not contain a hydroxyl group and that does not readily gel with a crosslinking agent.

Examples of the water-soluble binders include: polyvinyl alcohol resins having a hydroxyl group as a hydrophilic structural unit such as polyvinyl alcohol (PVA), acetoacetyl-modified polyvinyl alcohol, cation-modified polyvinyl alcohol, anion-modified polyvinyl alcohol, silanol-modified polyvinyl alcohol, polyvinyl acetal, or the like; cellulose-based resins such as methyl cellulose (MC), ethyl cellulose (EC), hydroxyethyl cellulose (HEC), carboxymethyl cellulose (CMC), hydroxypropyl cellulose (HPC), hydroxyethylmethyl cellulose, hydroxypropylmethyl cellulose, or the like; chitins; chitosans; starch; resins containing ether bonds such as polyethylene oxide (PEO), polypropylene oxide (PPO), polyethylene glycol (PEG), polyvinyl ether (PVE), or the like; or, resins containing carbamoyl groups such as polyacryl amide (PAAM), polyvinyl pyrrolidone (PVP), polyacrylic acid hydrazide, or the like. Further, examples of the binders include resins containing carboxyl groups as dissociation groups such as polyacrylates, maleic resins, alginates or gelatins.

Among these resins, preferable examples of the water-soluble binders used in the invention include at least one resin selected from polyvinyl alcohol-based resins, cellulose-based resins, resins containing ether bonds, resins containing carbamoyl groups, resins containing carboxyl groups and gelatins. In particular, polyvinyl alcohol (PVA)-based resins are preferable.

As the polyvinyl alcohol (PVA)-based resins, a fully saponified or partially saponified polyvinyl alcohol or a cation-modified polyvinyl alcohol can be used. In particular, a partially saponified polyvinyl alcohol with a saponification degree of 80% or more, or fully saponified polyvinyl alcohol is preferable.

Preferable examples of the cation-modified polyvinyl alcohol include a polyvinyl alcohol disclosed in JP-A No. 61-10483, in which the polyvinyl alcohol contains primary to tertiary amino groups or a quaternary ammonium group in a main chain or a side chain thereof.

To achieve a favorable strength of the ink receiving layer and favorable ink absorptivity, polyvinyl alcohol with a polymerization degree of 3,000 or more is preferably used as the polyvinyl alcohol-based resin. The upper limit of the preferable polymerization degree is about 6,000. The polymerization degree in the invention refers to an average polymerization degree, and when polyvinyl alcohols having different average polymerization degrees are used in a single layer, the polymerization degree refers to an average value of polymerization degrees for each individual polyvinyl alcohol. Further, in consideration of coating suitability or the like, an embodiment in which a polyvinyl alcohol with a polymerization degree of less than 3,000 is used in the coating liquid B, and a polyvinyl alcohol with a polymerization degree of 3,000 or more is used in the coating liquid C, is preferable.

In view of a desirable level of ink absorptivity and to reduce the occurrence of cracks, the total amount of the water-soluble binders in the ink receiving layer is preferably from 2.5 g/m$^2$ to 6 g/m$^2$, and more preferably from 3.0 g/m$^2$ to 5.0 g/m$^2$; the content of the water-soluble binders in the coating liquid B is preferably from 10 mass % to 40 mass %, and more preferably from 15 mass % to 25 mass %, with respect to the total solid content of the coating liquid B; and the content of the water-soluble binders in the coating liquid C is preferably from 5 mass % to 20 mass %, and more preferably from 7 mass % to 13 mass %, with respect to the total solid content of the coating liquid C.

Crosslinking Agent

The coating liquid A of the invention contains at least one crosslinking agent for crosslinking a water-soluble binder. By adding a crosslinking agent, the water-soluble binder can be crosslinked and cured, and thus film strength, film formability and water resistance of the ink receiving layer formed by use of a pseudo boehmite alumina hydrate can be enhanced The crosslinking agent may be contained in a coating liquid other than the coating liquid A. However, when a crosslinking agent is contained in the coating liquid B, the content ratio of the crosslinking agent relative to the content of the vapor-phase-process silica in the coating liquid B is less than 3% by mass. When the content is 3% by mass or more, coating defects may worsen. Thus, to reduce or prevent coating defects, preferably, the crosslinking agent is not contained in the coating liquid B.

Similarly, the content ratio of the crosslinking agent relative to the content of the pseudo boehmite alumina hydrate in the coating liquid C is preferably less than 3% by mass, and preferably, the crosslinking agent is not contained in the coating liquid C.

The crosslinking agent can be used as an aqueous solution in which one kind or more of crosslinking agents are dissolved in an aqueous solvent. As the aqueous solvent, as well as purified water or ion-exchange water, a mixed solvent of water and a water soluble organic solvent can be used; details of these will be provided below.

A suitable crosslinking agent can be selected appropriately upon consideration of the water-soluble binder contained in the ink receiving layer. When the water-soluble binder contained in the ink receiving layer is PVA, the crosslinking agent is preferably boric acid and/or salts thereof in view of obtaining a rapid crosslinking reaction. Boric acid such as orthoboric acid, metaboric acid, hypoboric acid, or the like can be used. Boric acid salts such as soluble salts of sodium salt, potassium salt, ammonium salt or the like are preferable. Specific examples of the boric acid salts include $Na_2B_4O_7.10H_2O$, $NaBO_2.4H_2O$, $K_2B_4O_7.5H_2O$, $NH_4HB_4O_7.3H_2O$, $NH_4BO_2$ and the like. However, the invention is not limited to these examples.

When gelatin and PVA are used in combination, the following compounds can be used as crosslinking agents other than boric acid and salts thereof. Examples of the compounds used as the crosslinking agents include aldehyde compounds such as formaldehyde, glyoxal or glutaraldehyde; ketone compounds such as diacetyl or cyclopentanedione; activated halogen compounds such as bis(2-chloroethylurea)-2-hydroxy-4,6-dichloro1,3,5-triazine or 2,4-dichloro-6-s-triazine sodium salt; activated vinyl compounds such as divinyl sulfonic acid, 1,3-vinylsulfonyl-2-propanol, N,N'-ethylenebis (vinylsulfonylacetamide) or 1,3,5-triacryloyl-hexahydro-s-triazine; N-methylol compounds such as dimethylol urea and methyloldimethyl hydantoin; melamine resins such as methylolmelamine or alkylated methylolmelamine); epoxy resins; isocyanate compounds such as 1,6-hexamethylene diisocyanate; aziridine compounds described in U.S. Pat. Nos. 3,017,280 and 2,983,611; carboxyimide compounds described in U.S. Pat. No. 3,100,704; epoxy compounds such as glycerol triglycidylether; ethyleneimino compounds such as 1,6-hexamethylene-N,N'-bisethyleneurea; halogenated carboxyaldehyde compounds such as mucochloric acid or mucophenoxychloric acid; dioxane compounds such as 2,3-dihydroxydioxane; metal-containing compounds such as titanium lactate, aluminum sulfate, chromium alum, potassium alum, zirconyl acetate, or chromium acetate; polymamine compounds such as tetraethylene pentamine; hydrazide compounds such as adipic acid dihyrazide; and low molecular weight compounds or polymers containing two or more oxazoline groups.

The crosslinking agent may be used alone or as a combination of two or more crosslinking agents.

The total content of the crosslinking agent in the ink receiving layer is preferably from 5 parts by mass to 40 parts by mass, and more preferably from 15 parts by mass to 35 parts by mass with respect to 100 parts by mass of the total amount of the water-soluble binder. When the content of the crosslinking agent is within the above ranges, occurrence of cracks or the like can be effectively prevented.

When boric acid and/or a salt thereof are used, the total amount of the boric acid and/or salt thereof with respect to the PVA is preferably from 5 mass % to 40 mass %, and more preferably from 15 mass % to 35 mass % in terms of $H_3BO_3$. When boric acid and/or a salt thereof are within the above ranges, an increase in the viscosity of a coating solution to be prepared is suppressed, and formability and water resistance of a film can be enhanced.

In order to prevent the occurrence of cracking as well as improve ink absorptivity, the total amount of the crosslinking agent in the ink receiving layer is preferably from 0.2 $g/m^2$ to 2 $g/m^2$, and more preferably from 0.4 $g/m^2$ to 1.2 $g/m^2$. Further, from the viewpoint of further suppressing coating defects, the content of the crosslinking agent in the ink receiving layer is preferably from 2 mass % to 8 mass %, and more preferably from 2.5 mass % to 6 mass % with respect to the content of pseudo boehmite alumina hydrate.

Other Components

The ink receiving layer of the invention (that is, at least one of the coating liquid A, the coating liquid B, the coating liquid C and other coating liquids) may further contain the following components if necessary.

Cationic Compound

The ink receiving layer of the invention preferably contains a cationic compound for the purpose of improving water resistance. Examples of the cationic compound include cationic polymers and water-soluble metal compounds.

Examples of the cationic compound used in the invention include cationic polymers and water-soluble metal compounds. Cationic polymers having primary to tertiary amino groups or a quaternary ammonium salt group are preferably used, and examples of these polymers include polyethylenimine, polydiallylamine, polyallylamine, and polymers described in JP-A Nos. 59-20696, 59-33176, 59-33177, 59-155088, 60-11389, 60-49990, 60-83882, 60-109894, 62-198493, 63-49478, 63-115780, 63-280681, 1-40371, 6-234268, 7-125411, 10-193776 and the like. A weight average molecular weight of these cationic polymers is preferably from 5,000 to 100,000.

The amount of the cationic polymer to be used is preferably in a range of from 1 mass % to 10 mass % with respect to the amount of the inorganic fine particles.

Examples of the water-soluble metal compounds used in the invention include water-soluble multivalent metal salts such as water-soluble metal salts of a metal selected from calcium, barium, manganese, copper, cobalt, nickel, aluminum, iron, zinc, zirconium, chromium, magnesium, tungsten, and molybdenum. Specific examples of the water-soluble multivalent metal salts include calcium acetate, calcium chloride, calcium formate, calcium sulfate, barium acetate, barium sulfate, barium phosphate, manganese chloride, manganese acetate, manganese formate dihydrate, manganese ammonium sulfate hexahydrate, cupric chloride, copper (II) ammonium chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidosulfate tetrahydrate, aluminum sulfate, aluminum sulfite, aluminum thiosulfate, polyaluminum chloride, aluminum nitrate nonahydrate, aluminum chloride hexahydrate, ferrous bromide, ferrous chloride, ferric chloride, ferrous sulfate, ferric sulfate, zinc phenolsulfonate, zinc bromide, zinc chloride, zinc nitrate hexahydrate, zinc sulfate, zirconium acetate, zirconium chloride, zirconium chloride octahydrate, zirconium hydroxychloride, chromium acetate, chromium sulfate, manganese sulfate, magnesium chloride hexahydrate, magnesium citrate nonahydrate, sodium phosphotungstate, sodium tungsten citrate, dodecatungstophosphoric acid n-hydrate, dodecatungstosilicic acid 26-hydrate, molybdenum chloride, dodecamolybdophosphoric acid n-hydrate, and the like. Among these compounds, the zirconium compounds are preferred in terms of the improved effect on transparency and water resistance.

Examples of the cationic compounds include inorganic aluminum-containing cationic polymers such as basic poly (aluminum hydroxide) compounds. The basic poly(aluminum hydroxide) compounds are water soluble poly(aluminum hydroxide) compounds, in which the main components thereof are represented by the following Formulae 1, 2 or 3, and contains polynuclear condensed ion which is basic and a polymer in a stable form, such as $[Al_6(OH)_{15}]^{3+}$, $[Al_8(OH)_{20}]^{4+}$, $[Al_{13}(OH)_{34}]^{5+}$, or $[Al_{21}(OH)_{60}]^{3+}$.

$$[Al_2(OH)_nCl_{6-n}]_m \quad \text{Formula 1}$$

$$[Al(OH)_3]_nAlCl_3 \quad \text{Formula 2}$$

$$Al_n(OH)_mCl_{(3n-m)}\ (0<m<3n) \quad \text{Formula 3}$$

These water-soluble aluminum compounds are commercially available as a water treatment agent poly(aluminum chloride) (trade name: PAC, manufactured by Taki Chemical Co. Ltd.), poly(aluminum-hydroxide) (trade name: Paho, manufactured by Asada Kagaku Co. Ltd.) and PURACHEM WT (trade name, manufactured by Riken Green Co. Ltd.), and from other manufacturers with the same objects whereby various kinds of different grades can be easily obtained. In the invention, these commercially available products may be used as such. However, when the products having a too low pH value are used, the products may be used by appropriately adjusting the pH value thereof.

In the invention, the content of the water-soluble metal compounds in the ink receiving layer is preferably from 0.1 $g/m^2$ to 10 $g/m^2$ and more preferably from 0.2 $g/m^2$ to 5 $g/m^2$.

The cationic compounds may be used as a combination of two or more cationic compounds. For example, the cationic polymer and the water-soluble metal compound may be used in combination.

The ink receiving layer of the invention preferably contains various oil droplets in order to improve film fragility of the ink receiving layer. Examples of the oil droplets include: a hydrophobic high-boiling organic solvent whose solubility with respect to water at a room temperature is 0.01 mass % or less (for example, liquid paraffin, dioctyl phthalate, tricresyl phosphate, and silicon oil) or polymer particles (for example, polymer particles obtained by the polymerization of one or more polymerizable monomers such as styrene, butylacrylate, divinylbenzene, butylmethacrylate, or hydroxyethylmethacrylate). The amount of the oil droplets with respect to the water-soluble binder is preferably from 10 mass % to 50 mass %.

In addition to the surfactant, the ink receiving layer may further contain a wide variety of known additives such as: a fixing agent for a coloring dye, a coloring pigment and an ink dye; an UV absorber; an antioxidant; a pigment dispersant; a defoaming agent; a leveling agent; a preservative; a fluorescent brightener; a viscosity stabilizer; or a pH adjusting agent.

Support

The support of the invention may not specifically be limited as long as an ink receiving layer can be formed on the support. For example, base paper or water resistant paper may be used. The thickness of the support is not specifically be limited, but is preferably from 50 μm to 250 μm.

Base Paper

Examples of the base paper include: chemical pulps such as LBKP, NBKP, LBSP, NBSP, LUKP, NUKP, LUSP or NUSP; virgin pulps such as mechanical pulps including GP and TMP; and recycled pulps from newspaper, magazines, office waste paper, and the like.

In the base paper, a white pigment having an average particle diameter of from 0.3 μm to 10 μm, such as at least one selected from calcium carbonate, magnesium carbonate, talc, kaolin, silica, alumina, titanium dioxide, barium sulfate, or the like, is used as a filler. The amount of the filler is 2 mass % to 30 mass % and preferably 4 mass % to 30 mass % with respect to the total solid content of the total pulp. A white pigment having an average particle diameter of 0.3 μm or more can improve the yield of paper, while a white pigment having an average particle diameter of 10 μm or less can improve the texture of paper.

A white pigment with a whiteness degree of 88% or higher according to JIS-M8016 is preferably used. When the content of the white pigment is 2 mass % or more, satisfactory white base paper can be obtained. When the content of white pigment is 30 mass % or less, the strength of the base paper can be improved and stains that occur during the manufacture of the base paper can be prevented. The base paper may be blended with additives generally used in paper making, such as various sizing agents, paper strength enhancers, antistatic agents, fluorescent whitening agents, or dyes.

Further, the surface of the base paper can be coated with surface sizing agents, surface paper strengthening agents, fluorescent whitening agents, antistatic agents, dyes, anchoring agents, or the like.

The thickness of the base paper is preferably from 70 μm to 200 μm. The thickness can be adjusted by compressing paper by applying pressure using a calendar during or after paper making.

When base paper is used as a support of the invention, from the viewpoint of glossiness, it is preferred that the surface of an ink receiving layer formed thereon is subjected to a calendering treatment. The calendering treatment can be carried out, for example, by a calender apparatus with a mirror surface roll (mirror surface drum).

Preferably, in the calendering treatment, the uppermost layer of the support is, at a nip region between the heated surface of a mirror surface drum and a press roll, brought into contact with a re-wetting liquid having a temperature of 92° C. or more, preferably 95° C. or more, for a wetting duration of 25 milliseconds or less, preferably 20 milliseconds or less, and the temperature of the surface of the mirror surface drum in press-contact with the uppermost layer in a wet state is 95° C. or more, and preferably 97° C. or more.

Water Resistant Support

Examples of water resistant supports include films and resin coated papers such as polyethylene, polypropylene, polyvinylchloride, diacetate resins, triacetate resins, cellophane, acrylic resins, polyethylene terephthalate and polyethylene naphthalate.

The resin coated papers indicate a support in which one surface (preferably both surfaces) of the base paper is coated with a resin.

Examples of the resin include: a polyolefin resin such as an olefin homopolymer including low density polyethylene having a density of from 0.91 $g/cm^3$ to 0.93 $g/cm^3$, high density polyethylene having a density of from 0.94 $g/cm^3$ to 0.96 $g/cm^3$, medium density polyethylene having a medium density, polypropylene, polybutene, and polypentene, an olefin copolymer obtained by copolymerizing two or more olefins such as ethylene-propylene copolymers, or a mixture thereof; and a resin having various densities and melt viscosity indices (melt indices) such as polyvinyl chloride, polyvinylidene chloride, polymethyl methacrylate, or polystyrene, being used alone or in combination. From the viewpoint of handleability, a polyolefin resin is preferably used. Low density polyethylene having a density of from 0.91 g/cm$^3$ to 0.93 g/cm$^3$ is preferably used.

A resin coating layer containing a low density polyethylene having a density of from 0.91 g/cm$^3$ to 0.93 g/cm$^3$ in the amount of 50 mass % or more with respect to the total solid content of resin is particularly preferable.

In the resin coating layer of the resin coated paper, at least on the side where the ink receiving layer is to be provided, at least one white pigment having an average particle diameter of from 0.1 μm to 1 μm, such as titanium dioxide, barium sulfate, zinc oxide, calcium carbonate, or magnesium carbonate may be included. The amount of the white pigment is from 5 mass % to 20 mass % with respect to the total solid content of the total resins, and preferably from 7 mass % to 15 mass %. If the white pigment has an average particle diameter of 0.1 μm or less, a concealing effect due to the white pigment may be insufficient; if the white pigment has an average particle diameter of 1 μm or more, the white pigment may deteriorate the surface properties of the resin coating layer. A white pigment with a degree of whiteness of 88% or higher according to JIS-M8016 is preferably used. When the content of white pigment with respect to the total solid content of the resin is 5 mass % or more, sufficient opaqueness of the resin coated paper can be obtained even in a thin base paper. When the content of white pigment with respect to the total solid content of the resin is 20 mass % or less, the surface strength of the resin coating layer can be maintained by preventing unevenness caused by scratches or the like. Other additives can be added, singly or in combination, as appropriate, and examples thereof include fatty acid amides such as stearic acid amide or arachidic acid amide, metal salts of fatty acids such as zinc stearate, calcium stearate, aluminum stearate, or magnesium stearate, antioxidants such as Illuganox 1010 or Illuganox 1076, blue pigment or dyes such as cobalt blue, ultramarine blue, cecilian blue or phthalocyanine blue, magenta pigments or dyes such as cobalt violet, fast violet or manganese violet, fluorescent bleaching agents, and ultraviolet absorbing agents.

The resin coated paper is generally produced by a so-called extrusion coating method, in which a heated and melted thermoplastic resin is flowed onto a running base paper, and thereby the base paper is coated with the resin. Further, it is preferred to conduct an activation treatment such as a corona discharge treatment or a flame treatment on the base paper before the base paper is coated with the resin. While a resin coated layer on the back surface of the base paper is ordinarily not glossy, the activation treatment such as the corona discharge treatment or the flame treatment may be conducted either on the front surface or both (front and back) surfaces of the base paper as necessary.

A resin layer of the front side of the resin coated paper, on which the ink receiving layer is formed, is mainly produced by an extrusion method, in which a thermoplastic resin heated and melted are extruded as a film by an extruder into between a base paper and a cooling roll, adhered by pressure, and cooled. In this case, the cooling roll is used for forming the surface shape of the resin coated layer, and thereby the surface of the resin layer is formed (embossed) into a mirrored surface, a finely roughened surface or a patterned surface such as a silk finish, a matte finish or the like depending on the surface shape of the cooling roll.

The resin layer of the back side of the resin coated paper, which is the opposite side of the resin layer of the front side, can also be produced by a method, in which a resin heated and melted are extruded as a film by an extruder into between a base paper and a cooling roll, adhered by pressure, and cooled In this case, from a viewpoint of transportability in a priner, preferably, the surface of the resin layer is formed (embossed) into a finely roughened surface or a patterned surface such as a silk finish or a matte finish in accordance with the surface shape of the cooling roll so as to have an Ra according to JIS-B-0601 (corresponds to ISO 4287 (1997)) of from 0.8 μm to 5 μm.

Other than the coating method in which a resin is heated and melted by extrusion, a method for providing the resin coating layer on the base paper include: a method in which an electron beam curable resin is coated and then an electron beam is irradiated, and a method in which a polyolefin resin emulsion coating liquid is coated, dried, and subjected to a surface smoothing treatment. Furthermore, by conducting a shaping (embossing) process using a heat roll such as a roll having concave portions and convex portions, a resin coated paper suitable for the invention can be obtained In order to improve adhesive property, an undercoat layer may be provided on the front side surface of the resin coated paper. The undercoat layer is coated and dried on the surface of the resin layer of a support in advance, before an ink receiving layer is coated thereon. The undercoat layer is a layer which mainly includes a water soluble polymer or a polymer latex from which a film can be formed. The water soluble polymer such as gelatin, polyvinyl alcohols, polyvinyl pyrrolidone or water-soluble cellulose is preferably used, and among these polymers, gelatin is particularly preferable. The amount of the water-soluble polymer adhered is preferably from 10 mg/m$^2$ to 500 mg/m$^2$, and more preferably from 20 mg/m$^2$ to 300 mg/m$^2$. It is preferred that the undercoat layer further contains surfactants or film hardening agents. Moreover, before the undercoat layer is formed (by coating or the like) on the resin coated paper, a corona discharge treatment is preferably conducted.

EXAMPLES

The present invention will be described in detail with reference to the examples. However, the following examples do not limit the scope of the invention. "Parts" and "%" in the examples means "parts by mass" and "% by mass" unless otherwise specified. Further, in the examples, descriptions will be given with a central focus on preparation for inkjet recording sheets as an example of inkjet recording media.

Example 1

Preparation of Pseudo Boehmite Alumina Hydrate Dispersion 708 g of pseudo boehmite alumina hydrate (trade name: CATALOID AP-5, manufactured by Catalysts & Chemicals Ind. Co., Ltd.; average primary particle diameter: 8 nm) was added to 2042 g of ion exchange water while being stirred using a dissolver to obtain a white colored coarse dispersion liquid of alumina. The rotation frequency of the dissolver was 3000 r.p.m., and the rotation duration was 10 minutes.

Subsequently, the alumina coarse dispersion liquid was finely dispersed by using a high pressure dispersing machine (trade name: ULTIMIZER HJP25005, manufactured by Sugino Machine Limited) to obtain a white colored transparent alumina dispersion liquid (dispersion liquid of pseudo boehmite alumina hydrate) with a solid content of 25%. At this stage, the pressure was 100 MPa and the discharge amount was 600 g/min.

After the obtained dispersion liquid of pseudo boehmite alumina hydrate was adjusted to have a liquid temperature of 30° C. and diluted with ion exchange water, the particle diameter of the dispersed particles was measured by a dynamic light scattering particle diameter measuring apparatus (trade name: LB-500, manufactured by Horiba Ltd.). The particle diameter of the dispersed particles of the obtained pseudo boehmite alumina hydrate dispersion liquid was 0.06 μm.

Preparation of Vapor-Phase-Process Silica Dispersion 35 g of diallyl dimethylammonium chloride (trade name: SHAROL DC902P, manufactured by Dai-ichi Kogyo Seiyaku Co., Ltd.) was added to 3365 g of ion exchange water while being stirred using a dissolver, and 600 g of vapor-phase-process silica (trade name: AEROSIL300, manufactured by Nippon Aerosil Co.; average primary particle diameter: 7 nm) was added thereto to obtain a vapor-phase-process silica coarse dispersion liquid. The rotation speed of the dissolver was 3000 r.p.m., and the rotation duration was 10 minutes. The vapor-phase-process silica coarse dispersion liquid was finely dispersed by using a high pressure dispersing machine (trade name: ULTIMIZER HJP25005, manufactured by Sugino Machine limited) to obtain a white color transparent vapor-phase-process silica dispersion liquid with a solid content of 15 mass %. At this stage, the pressure was 100 MPa and the discharge amount was 600 g/min. The particle diameter of the dispersed particles of the white color transparent vapor-phase-process silica dispersion liquid was measured in a manner similar to the measurement of the dispersed particles of the alumina white color transparent dispersion liquid, and a particle diameter of 0.1040 μm was obtained.

Preparation of Coating Liquid C (Uppermost Layer)

937.5 g of the pseudo boehmite alumina hydrate dispersion obtained in the above, 321.0 g of a 7% aqueous solution of polyvinyl alcohol with a saponification degree of 88% and a polymerization degree of 4,500 (trade name: PVA 245, manufactured by Kuraray Co., Ltd.), 12.3 g of a 10% aqueous solution of a surfactant (trade name: SWANOL AM2150, manufactured by Nikko Chemicals Co., Ltd.), and 465 g of ion exchange water were each heated to a temperature of 60° C. before mixing. The liquids were mixed well while maintaining the temperature thereof at 60° C. to obtain a coating solution C (the uppermost layer). Here, the "uppermost layer" refers to the farthest layer from the support in a simultaneous multi-layer coating method, which will be described later.

Preparation of Coating Liquid B (Intermediate Layer)

892.2 g of the vapor-phase-process silica dispersion obtained in the above process, 467.4 g of a 7% aqueous solution of polyvinyl alcohol with a saponification degree of 88% and a polymerization degree of 4,500 (trade name: PVA 245, manufactured by Kuraray Co., Ltd.), 16.2 g of a 10% aqueous solution of a surfactant (trade name: SWANOL AM2150, manufactured by Nikko Chemicals Co., Ltd.), 84.2 g of ion exchange water, and 160 g of 59% ethanol for industrial use (trade name: AP-7, manufactured by Japan Alcohol Corporation) were each heated to a temperature of 30° C. before mixing. The liquids were mixed well while maintaining the temperature thereof at 30° C. to obtain a coating solution B (intermediate layer). Here, the "intermediate layer" refers to a layer positioned between the farthest layer from the support in the above and the bottom layer, which will be described later, in a simultaneous multi-layer coating method, which will be also described later.

Preparation of Coating Liquid A (Bottom Layer)

200 g of a 7.5% aqueous boric acid solution and 150 g of an 8% aqueous polyethylene oxide solution (trade name: ALKOX R1000, manufactured by Meisei Chemical Works, Ltd.) were mixed to obtain a coating liquid A (the bottom layer). Here, the "bottom layer" refers to the layer closest to the support in a simultaneous multi-layer coating method, which will be described later.

Preparation of Support

A mixture of 1:1 of a hardwood bleached kraft pulp (LBKP) and a softwood bleached sulfite pulp (NBSP) was beaten to Canadian Standard Freeness of 300 ml to give a pulp slurry. Then, an alkylketene dimmer (as a sizing agent in an amount of 0.5 mass % relative to the pulp), polyacrylamide (as a strengthening agent in an amount of 1.0 mass % relative to the pulp), a cationated starch (in an amount of 2.0 mass % relative to the pulp), and a polyamide epichlorohydrin resin (in an amount of 0.5 mass % relative to the pulp) were added to the obtained pulp slurry, and the mixture was diluted with water to form a 1% slurry.

The 1% slurry was made into paper to a basis weight of 170 g/m$^2$ by using a Fourdrinier paper machine, and then dried and moisture-adjusted to obtain base paper.

Next, a polyethylene resin composition, in which 10 mass % of an anatase titanium was uniformly dispersed in 100 mass % of a resin of a low density polyethylene with a density of 0.918 g/cm$^3$, was melted at 320° C. The melted polyethylene resin composition was extruded to a thickness of 35 μm at a speed of 200 m/minute onto one surface of the above-described base paper (hereinafter, sometimes referred to as a "front surface" of a polyolefin resin coated paper), and then extrusion-coated by using a cooling roll with a finely roughened fabricated surface.

Next, a blended resin, in which 70 mass % of a resin of a high density polyethylene with a density of 0.962 g/cm$^3$ and 30 mass % of a resin of a low density polyethylene with a density of 0.918 g/cm$^3$ are blended, was melted at 320° C. The melted blended resin composition was extruded to a thickness of 30 μm onto the other surface of the base paper (hereinafter, sometimes referred to as a "back surface" of a polyolefin resin coated paper), and then extrusion-coated by using a cooling roll with a finely roughened fabricated surface.

In the above manner, a polyolefin resin coated paper (PRC paper) was obtained.

Next, after the front surface of the polyolefin resin coated paper was subjected to a high frequency corona electrical discharge treatment, an undercoat layer having the following formulation was coated and dried on the front surface, such that a coating amount of a lime-processed gelatin was 50 mg/m$^2$, to obtain a water-resistant support (a support).

| Formulation of Undercoat Layer | |
|---|---|
| Lime-processed gelatin | 100 parts |
| Sulfosuccinic acid-2-ethylhexylester salt | 2 parts |
| Chromium alum | 10 parts |

Formation of Ink Receiving Layer

First, the coating liquid A, coating liquid B and coating liquid C obtained according to the above description were each heated to a temperature of 45° C. Thereafter, on the undercoat layer of the support, the coating liquid A, the coating liquid B and the coating liquid C were coated in this order from the support by use of a slide bead coating apparatus (simultaneous multi-layer coating).

The simultaneous multi-layer coating was carried out in such a manner that the coating amount of the pseudo boehmite alumina hydrate in the coating liquid C (uppermost layer) was 20 g/m$^2$, the coating amount of the vapor-phase-process silica in the coating liquid B (intermediate layer) was 9 g/m$^2$, and the coating amount of the boric acid in the coating liquid A (bottom layer) was 0.6 g/m$^2$.

Next, the obtained coated films were cooled for 30 seconds to obtain a film surface temperature of 12° C., and then dried at 45° C. and 10% R.H., and thereafter, dried at 35° C. and 10% R.H. to provide a total solid concentration of 90 mass %

Thereafter, the above dried coated films were set-dried for 2 minutes to obtain a film surface temperature of 20° C., and thereafter, dried at 80° C. for 10 minutes.

In the above manner, an ink receiving layer was formed on the undercoat layer, and an ink recording sheet was obtained. The thickness of the ink receiving layer thus formed was 45 μm.

Evaluation

The inkjet recording sheet obtained in the above was evaluated with regard to the following. The results of the evaluation are shown in Tables 1 and 2.

(1) Image Printing Density

A black solid image was printed on the ink receiving layer of the above ink jet recording sheet by using Inkjet Printer PM-A820 (trade name, manufactured by Seiko Epson Corporation). The image printing density of the black (Bk) solid printed portion was measured by using a spectrophotometer (trade name: SPECTRORINO SPM-50, manufactured by Gretag Macbeth) with a view angle of 2°, and a light source of D50, and no filter.

(2) Glossiness

The glossiness of the surface of the ink receiving layer of the inkjet recording sheet before printing was measured by using a digital variable glossmeter UGV-5D, (trade name, manufactured by Suga Test Instruments Co., Ltd.; measuring pore: 8 mm) with an incident angle of 60° and a light receiving angle of 60°.

(3) Coating Defects 100 m$^2$ of an inkjet recording sheet was produced, and the number of defective portions thereof over 3 mm, and the frequency of occurrence of coating unevenness per 100 m$^2$ were visually inspected, and comparisons were made based on the following criteria:

Evaluation Criteria

A: the number of defective portions is one or less;

B: the number of defective portions is in a range of from 2 to 10;

C: the number of defective portions is in a range of from 11 to 100;

D: the number of defective portions is in a range of from 101 to 1000; and

E: the number of defective portions is in a range of from 1001 to 2000.

Example 2

An inkjet recording sheet was prepared in a manner similar to Example 1 except that the binders of the coating liquid C (uppermost layer) and the coating liquid B (intermediate layer) were changed to an acetoacetyl-modified PVA (trade name: COHSEFIRMER Z210, manufactured by The Nippon Synthetic Chemical Industry Co., Ltd.; acetoacetylation degree: 3%; saponification degree: 98%; average polymerization degree: 2350), and that the crosslinking agent in the bottom layer was changed to adipic acid dihydrazide. The inkjet recording sheet thus obtained was evaluated in a manner similar to in Example 1. The results of the evaluation are shown in Tables 1 and 2.

Example 3

An inkjet recording sheet was prepared in a similar manner to Example 1 except that a dispersion liquid of the pseudo boehmite alumina hydrate was prepared in the following manner. The obtained inkjet recording sheet was evaluated in a manner similar to Example 1. The results of the evaluation are shown in Tables 1 and 2.

Preparation of Dispersion of Pseudo Boehmite Alumina Hydrate 1200 g of ion-exchange water and 900 g of isopropyl alcohol were placed in a 3 liter reaction vessel and heated to a temperature of 75° C. 408 g of aluminum isopropoxide was added thereto and the mixture was hydrolyzed at 75° C. for 24 hours and then at 95° C. for 4 hours. Thereafter, 24 g of acetic acid was added thereto, the mixture was stirred at 95° C. for 48 hours and then concentrated to provide a solid concentration of 15%, thereby obtaining a white dispersion liquid of aluminum hydroxide (alumina white transparent dispersion liquid).

The sol (alumina white transparent dispersion liquid) was dried at room temperature, and upon examination by X-ray diffraction exhibited a pseudo boehmite structure. Further, upon measuring an average primary particle diameter of the particles with a transmission electron microscope, it was found that an alumina hydrate of the invention exhibited a tabulate pseudo boehmite structure having a diameter of about 30 nm and an aspect ratio of 6. By means of a nitrogen adsorption-desorption method, a BET specific surface area, an average pore radius, pore volumes with a radius of from 1 nm to 30 nm, and pore volumes with a radius of from 2 nm to 10 nm, of the alumina hydrate were measured, obtaining values of 136 m$^2$/g, 5.8 nm, 0.54 ml/g and 0.50 ml/g, respectively.

Example 4

An inkjet recording sheet was prepared in a similar manner to Example 1, except that the vapor-phase-process silica was changed from AEROSIL 300 to AEROSIL OX50 (trade name, manufactured by Nippon Aerosil Co.; average primary particle diameter: 40 nm). The obtained inkjet recording sheet was evaluated in a manner similar to Example 1. The results of the evaluation are shown in Tables 1 and 2.

Example 5

An inkjet recording sheet was prepared in a similar manner to Example 1, except that 2 parts of potassium oleate relative to the pseudo boehmite was added to the uppermost layer, the method for preparing the support was changed to the following method, and the formed ink receiving layer was subjected to the following calendering treatment.

The obtained inkjet recording sheet was evaluated in a manner similar to Example 1. The results of the evaluation are shown in Tables 1 and 2.

Preparation of Support

To 100 parts of wood pulp composed of LBKP (freeness: 400 ml CSF) and 20 parts of NBKP (freeness: 400 ml CSF), 25 parts of pigment (containing a light calcium carbonate, a heavy calcium carbonate and talc at a ratio of 10/10/10), 0.1 parts of a commercially available alkyl ketene dimer, 0.03 parts of a commercially available cationic (meth)acrylamide, 0.80 parts of a commercially available cationic starch and 0.40 parts of sulfuric acid band, were formulated to form a mixture, which was then made into paper using a Fourdrinier paper machine, whereby a base paper (support) with a basis weight of 90 g/m$^2$ was obtained.

Calendering Treatment

An ink receiving layer was formed on the base paper in the above in a manner similar to Example 1.

The surface of the formed ink receiving layer was subjected to a re-wet casting (calendering treatment) by using an apparatus provided with a press roll having a diameter of 300 mm and a mirror surface drum having a diameter of 1250 mm, and a nozzle disposed above the nip, under the following conditions, thereby obtaining an inkjet recording sheet (inkjet cast coat paper).

| Re-wet casting conditions | |
|---|---|
| Re-wetting liquid | heated water |
| Temperature of re-wetting liquid | 95° C. |
| Temperature of surface of mirror surface drum | 95° C. |
| Press nip pressure | 150 kg/cm$^2$ |
| Wetting duration | 20 milliseconds |

Comparative Example 1

An inkjet recording sheet was prepared in a manner similar to Example 1 except that the coating liquid B (intermediate layer) was not used.

The obtained inkjet recording sheet was evaluated in a manner similar to Example 1.

The results of the evaluation are shown in Tables 1 and 2.

Comparative Example 2

An inkjet recording sheet was prepared in a manner similar to Example 1 except that the coating liquid A (bottom layer) was not used, and boric acid was additionally added to the coating liquid C (uppermost layer) and the coating liquid B (intermediate layer).

The obtained inkjet recording sheet was evaluated in a manner similar to Example 1.

The results of the evaluation are shown in Tables 1 and 2.

Comparative Example 3

An inkjet recording sheet was prepared in a manner similar to in Example 1 except that the coating liquid C (uppermost layer) was not used.

The obtained inkjet recording sheet was evaluated in a manner similar to in Example 1.

The results of the evaluation are shown in Tables 1 and 2.

Comparative Example 4

An inkjet recording sheet was prepared in a manner similar to in Example 1 except that the coating liquid A (bottom layer) was not used.

The obtained inkjet recording sheet was evaluated in a manner similar to in Example 1. The results of the evaluation are shown in Tables 1 and 2.

TABLE 1

| | | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|---|
| Formulation of Coating Liquid C (Uppermost layer) | Pseudo boehmite alumina hydrate | CATALOID AP-5 | CATALOID AP-5 | Synthetic product | CATALOID AP-5 | CATALOID AP-5 | CATALOID AP-5 | CATALOID AP-5 | — | CATALOID AP-5 |
| | Water-soluble binder | PVA245 | Acetoacetyl-modified PVA | PVA245 | PVA245 | PVA245 | PVA245 | PVA245 | — | PVA245 |
| | Surfactant | AM2150 | AM2150 | AM2150 | AM2150 | AM2150 | AM2150 | AM2150 | — | AM2150 |
| | Cross-linking agent | — | — | — | — | — | — | Boric acid | — | — |
| Formulation of Coating Liquid B (Intermediate layer) | Vapor-phase-process silica | AEROSIL 300 | AEROSIL 300 | AEROSIL 300 | AEROSIL 300 | AEROSIL 300 | — | AEROSIL 300 | AEROSIL 300 | AEROSIL 300 |
| | Water-soluble binder | PVA245 | Acetoacetyl-modified PVA | PVA245 | PVA245 | PVA245 | — | PVA245 | PVA245 | PVA245 |
| | Surfactant | AM2150 | AM2150 | AM2150 | AM2150 | AM2150 | — | AM2150 | AM2150 | AM2150 |
| | Cross-linking agent | — | — | — | — | — | — | Boric acid | — | — |

TABLE 2

| | | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|---|
| Formulation of Coating Liquid A (bottom layer) | Cross-linking agent | Boric acid | Adipic acid hydrazide | Boric acid | Boric acid | Boric acid | Boric acid | — | Boric acid | — |
| | Water-soluble binder | ALKOX R1000 | ALKOX R1000 | ALKOX R1000 | ALKOX R1000 | ALKOX R1000 | ALKOX R1000 | — | ALKOX R1000 | — |
| Support | | PRC Paper + Undercoat layer | PRC Paper + Undercoat layer | PRC Paper + Undercoat layer | PRC Paper + Undercoat layer | Base paper | PRC Paper + Undercoat layer | PRC Paper + Undercoat layer | PRC Paper + Undercoat layer | PRC Paper + Undercoat layer |
| Glossiness (%) | | 48 | 45 | 45 | 48 | 55 | 45 | 38 | 35 | Film could not be formed |
| Printing density | | 2.98 | 2.98 | 2.93 | 2.92 | 2.98 | 2.88 | 2.85 | 2.5 | |
| Coating defects | | B | A | B | B | B | E | E | B | |

From Tables 1 and 2, it may be seen that the inkjet recording sheets of Examples 1 to 5 according to the invention respectively exhibit high printing densities in addition to suppressed coating defects. On the other hand, in Comparative Example 1 which did not include the coating liquid B, and in Comparative Example 2 which included the crosslinking agent in the coating liquid B and C but did not contain the coating liquid A, coating defects worsened. In addition, in Comparative example 3 which did not include the coating liquid C, printing density was inferior. In Comparative Example 4 which did not include the coating liquid A, a coated film (an ink receiving layer) could not be formed.

What is claimed is:

1. A method for manufacturing an inkjet recording medium comprising applying, on a support, a coating liquid A, a coating liquid B and a coating liquid C in this order from the support to form an ink receiving layer, the coating liquid A comprising a crosslinking agent;

the coating liquid B comprising vapor-phase-process silica and a water-soluble binder, wherein the content of a pseudo boehmite alumina hydrate in the coating liquid B is less than 3% by mass with respect to the content of the vapor-phase-process silica, and the content of a crosslinking agent in the coating liquid B is less than 3% by mass with respect to the content of the vapor-phase-process silica; and the coating liquid C comprising a pseudo boehmite alumina hydrate and a water-soluble binder.

2. The method for manufacturing an inkjet recording medium according to claim 1, wherein an average primary particle diameter of the vapor-phase-process silica contained in the coating liquid A is from 3 nm to 20 nm, and an average primary particle diameter of the pseudo boehmite alumina hydrate contained in the coating liquid C is from 3 nm to 20 nm.

3. The method for manufacturing an inkjet recording medium according to claim 1, wherein the support is formed of a base paper, and the method further comprises subjecting the surface of an ink receiving layer provided on the base paper to a calendering treatment.

4. The method for manufacturing an inkjet recording medium according to claim 2, wherein the support is formed of a base paper, and the method further comprises subjecting the surface of an ink receiving layer provided on the base paper to a calendering treatment.

5. The method for manufacturing an inkjet recording medium according to claim 1, wherein the support is water resistant.

6. The method for manufacturing an inkjet recording medium according to claim 2, wherein the support is water resistant.

7. The method for manufacturing an inkjet recording medium according to claim 3, wherein the support is water resistant.

8. The method for manufacturing an inkjet recording medium according to claim 4, wherein the support is water resistant.

* * * * *